US010078298B2

(12) United States Patent
Sato

(10) Patent No.: US 10,078,298 B2
(45) Date of Patent: Sep. 18, 2018

(54) IMAGE FORMING APPARATUS AND FIXING APPARATUS

(71) Applicant: CANON KABUSHIKI KAISHA, Tokyo (JP)

(72) Inventor: Tomonori Sato, Kakegawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/648,304

(22) Filed: Jul. 12, 2017

(65) Prior Publication Data

US 2018/0024476 A1 Jan. 25, 2018

(30) Foreign Application Priority Data

Jul. 21, 2016 (JP) ..... 2016-143009

(51) Int. Cl.
*G03G 15/20* (2006.01)
*G03G 15/04* (2006.01)
*G03G 15/00* (2006.01)

(52) U.S. Cl.
CPC ... *G03G 15/2017* (2013.01); *G03G 15/04072* (2013.01); *G03G 15/2039* (2013.01); *G03G 15/80* (2013.01)

(58) Field of Classification Search
CPC ..... G03G 15/2017; G03G 15/2039; G03G 15/2046
See application file for complete search history.

(56) References Cited

U.S. PATENT DOCUMENTS 5,768,655 A * 6/1998 Yoshino ..... G03G 15/2003 219/216
9,069,302 B2 * 6/2015 Samei ..... G03G 15/2039
9,075,356 B2 * 7/2015 Ooyanagi ..... G03G 15/2039
9,091,974 B2 * 7/2015 Yoshioka ..... G03G 15/2039

FOREIGN PATENT DOCUMENTS

JP 2006-154413 A 6/2006
JP 2009-92688 A 4/2009
JP 2015-148778 A 8/2015
JP 2015-179124 A 10/2015

* cited by examiner

*Primary Examiner* — Gregory H Curran
(74) *Attorney, Agent, or Firm* — Canon U.S.A., Inc. IP Division

(57) ABSTRACT

An image forming apparatus includes a fixing unit having a heating member, a temperature detection member detecting a temperature of the heating member, a control unit controlling power to be supplied to a heater, and an acquisition unit that acquires toner density information of the toner image to be formed on the recording material, wherein the acquisition unit acquires first toner density information in a predetermined area which is a portion of a maximum image formation area of the recording material and second toner density information in the maximum image formation area, and the predetermined area is an area including an area of the recording material corresponding to a detected area of the heating member detected by the temperature detection member, wherein the control unit sets the target temperature based on the first toner density information and the second toner density information.

13 Claims, 17 Drawing Sheets

FIG. 6

| PATTERN | AREA A (mg/cm2) | OUTSIDE AREA A (mg/cm2) | SETTING TEMPERATURE [°C] AND ADVERSE EFFECT ON IMAGE | | | | | | | | | | | | | | | | | | | | | |
|---|---|---|---|---|---|---|---|---|---|---|---|---|---|---|---|---|---|---|---|---|---|---|---|---|
| | | | 168 | | 170 | | 172 | | 174 | | 176 | | 178 | | 180 | | 182 | | 184 | | 186 | | 188 | |
| | | | FIXING | off | FIXING | off | FIXING | off | FIXING | off | FIXING | off | FIXING | off | FIXING | off | FIXING | off | FIXING | off | FIXING | off | FIXING | off |
| 1-1 | 0.00 | 0.60 | × | × | × | △ | × | ○ | × | ○ | △ | ○ | △ | ○ | ○ | ○ | ○ | ○ | ○ | ○ | ○ | ○ | ○ | △ |
| 1-2 | 0.20 | 0.60 | × | △ | × | ○ | × | ○ | × | ○ | △ | ○ | ○ | ○ | ○ | ○ | ○ | ○ | ○ | ○ | ○ | △ | ○ | × |
| 1-3 | 0.40 | 0.60 | × | ○ | × | ○ | × | ○ | △ | ○ | ○ | ○ | ○ | ○ | ○ | ○ | ○ | ○ | ○ | △ | ○ | △ | ○ | × |
| 1-4 | 0.60 | 0.60 | × | ○ | × | ○ | △ | ○ | ○ | ○ | ○ | ○ | ○ | ○ | ○ | ○ | ○ | △ | ○ | × | ○ | × | ○ | × |

FIG. 7

| PATTERN | AREA A (mg/cm2) | OUTSIDE AREA A (mg/cm2) | CONVENTIONAL TECHNOLOGY | | APPLICATION OF PRESENT CONTROL | | REDUCTION EFFECT [W] |
|---|---|---|---|---|---|---|---|
| | | | SETTING TEMPERATURE [°C] | POWER [W] | SETTING TEMPERATURE [°C] | POWER [W] | |
| 1-1 | 0.00 | 0.60 | 180 | 628 | 180 | 628 | 0 |
| 1-2 | 0.20 | 0.60 | 180 | 640 | 178 | 629 | 11 |
| 1-3 | 0.40 | 0.60 | 180 | 651 | 176 | 631 | 20 |
| 1-4 | 0.60 | 0.60 | 180 | 662 | 174 | 633 | 29 |

FIG. 10

| AREA A (mg/cm2) | AREA B (mg/cm2) | SETTING TEMPERATURE [°C] AND ADVERSE EFFECT ON IMAGE | | | | | | | | | | | | | | | | | | | | | |
|---|---|---|---|---|---|---|---|---|---|---|---|---|---|---|---|---|---|---|---|---|---|---|---|
| | | 168 | | 170 | | 172 | | 174 | | 176 | | 178 | | 180 | | 182 | | 184 | | 186 | | 188 | |
| | | FIXING | off | FIXING | off | FIXING | off | FIXING | off | FIXING | off | FIXING | off | FIXING | off | FIXING | off | FIXING | off | FIXING | off | FIXING | off |
| 0.00 | 0.05 | × | ○ | △ | ○ | △ | ○ | ○ | ○ | ○ | ○ | ○ | ○ | ○ | ○ | ○ | ○ | ○ | ○ | ○ | △ | ○ | × |
| 0.00 | 0.20 | × | ○ | × | ○ | △ | ○ | △ | ○ | ○ | ○ | ○ | ○ | ○ | ○ | ○ | ○ | ○ | ○ | ○ | △ | ○ | × |
| 0.00 | 0.40 | × | △ | × | ○ | × | ○ | △ | ○ | △ | ○ | ○ | ○ | ○ | ○ | ○ | ○ | ○ | ○ | ○ | ○ | ○ | × |
| 0.00 | 0.60 | × | × | × | △ | × | ○ | × | ○ | △ | ○ | △ | ○ | ○ | ○ | ○ | ○ | ○ | ○ | ○ | ○ | ○ | △ |

FIG. 12

| PATTERN | AREA A (mg/cm2) | AREA B (mg/cm2) | APPLICATION OF FIRST EXEMPLARY EMBODIMENT | | APPLICATION OF PRESENT CONTROL | | REDUCTION EFFECT [W] |
|---|---|---|---|---|---|---|---|
| | | | SETTING TEMPERATURE [°C] | POWER [W] | SETTING TEMPERATURE [°C] | POWER [W] | |
| 1-1 | 0.00 | 0.60 | 180 | 628 | 180 | 628 | 0 |
| 1-2 | 0.20 | 0.60 | 178 | 629 | 178 | 629 | 0 |
| 1-3 | 0.40 | 0.60 | 176 | 631 | 176 | 631 | 0 |
| 1-4 | 0.60 | 0.60 | 174 | 633 | 174 | 633 | 0 |
| 2-1 | 0.00 | 0.40 | 180 | 628 | 178 | 618 | 10 |
| 2-2 | 0.20 | 0.40 | 178 | 629 | 176 | 619 | 10 |
| 2-3 | 0.40 | 0.40 | 176 | 631 | 174 | 620 | 11 |
| 3-1 | 0.00 | 0.20 | 180 | 628 | 176 | 615 | 13 |
| 3-2 | 0.20 | 0.20 | 178 | 629 | 174 | 614 | 15 |
| 4-1 | 0.00 | 0.05 | 180 | 628 | 174 | 609 | 19 |

FIG. 14

| | | FIRST | SECOND | THIRD | FOURTH | FIFTH | SIXTH | SEVENTH | EIGHTH | NINTH | TENTH | ELEVENTH | TWELFTH |
|---|---|---|---|---|---|---|---|---|---|---|---|---|---|
| SHEET-PASSING PATTERN | AREA A (mg/cm2) | 0.30 | 0.30 | 0.30 | 0.00 | 0.00 | 0.00 | 0.30 | 0.30 | 0.30 | 0.00 | 0.00 | 0.00 |
| | AREA B (mg/cm2) | 0.30 | 0.30 | 0.30 | 0.60 | 0.60 | 0.60 | 0.30 | 0.30 | 0.30 | 0.60 | 0.60 | 0.60 |
| | SETTING TEMPERATURE [°C] | 190 | 190 | 190 | 200 | 200 | 200 | 190 | 190 | 190 | 200 | 200 | 200 |

FIG. 15

| | | FIRST | SECOND | THIRD | FOURTH | FIFTH | SIXTH | SEVENTH | EIGHTH | NINTH | TENTH | ELEVENTH | TWELFTH |
|---|---|---|---|---|---|---|---|---|---|---|---|---|---|
| COMPARATIVE EXAMPLE 1 | SETTING TEMPERATURE [°C] | 190 | 190 | 190 | 200 | 200 | 200 | 190 | 190 | 190 | 200 | 200 | 200 |
| | FIXABILITY | ○ | ○ | ○ | × | ○ | ○ | △ | ○ | ○ | × | ○ | ○ |
| COMPARATIVE EXAMPLE 2 | SETTING TEMPERATURE [°C] | 195 | 195 | 195 | 200 | 200 | 200 | 195 | 195 | 195 | 200 | 200 | 200 |
| | FIXABILITY | ○ | ○ | ○ | ○ | ○ | ○ | ○ | ○ | ○ | ○ | ○ | ○ |
| PRESENT EXEMPLARY EMBODIMENT | SETTING TEMPERATURE [°C] | 190 | 190 | 195 | 200 | 200 | 200 | 195 | 190 | 195 | 200 | 200 | 200 |
| | FIXABILITY | ○ | ○ | ○ | ○ | ○ | ○ | ○ | ○ | ○ | ○ | ○ | ○ |

IMAGE FORMING APPARATUS AND FIXING APPARATUS

BACKGROUND

Field of the Disclosure

The present disclosure generally relates to image forming and, more particularly, to an image forming apparatus and a fixing apparatus.

Description of the Related Art

An image forming apparatus such as an electrophotographic copying machine or printer generates a toner image by developing an electronic latent image formed on a photosensitive member with scanning light of a laser scanner using toner and transfers the toner image from the photosensitive member to a recording material directly or via an image carrier such as an intermediate transfer member. Then, an image is formed by a fixing apparatus which heats and presses the recording material to which the toner image has been transferred. The fixing apparatus includes a fixing roller or a fixing sleeve heated by a heat source and a pressure roller which forms a fixing nip in contact with the fixing roller or the fixing sleeve.

Fixing setting conditions (a setting temperature of the fixing apparatus, a pressing force between a fixing roller or fixing sleeve and a pressure roller, a recording material conveyance speed of the fixing apparatus and the like) of the fixing apparatus are set such that a fixing failure does not occur when the amount of toner on the recording material set for the image forming apparatus is the largest. Particularly for a color image forming apparatus that uses toner of a plurality of colors, fixing setting conditions are set such that a fixing failure does not occur in a solid image at the time of maximum layer stack.

However, under such fixing setting conditions, a hot offset or curling of the recording material occurs due to excessive fixing in the case of an image generated only with a small amount of toner like black characters. Besides, power is consumed more than necessary.

To solve such problems, methods of changing fixing setting conditions can be considered. By such methods, the amount of toner is estimated from image density information. The image density is detected from image data which a host computer or an image scanner connected to an image forming apparatus transmits, as discussed in Japanese Patent Application Laid-Open No. 2006-154413, and Japanese Patent Application Laid-Open No. 2009-92688. In Japanese Patent Application Laid-Open No. 2006-154413, when an image is formed by dots in an image forming apparatus which uses a plurality of color toners, overlapping of dots is detected and fixing setting conditions are changed according to the overlapping number of dots. In Japanese Patent Application Laid-Open No. 2009-92688, in an image forming apparatus similarly using a plurality of color toners, overlapping of color toners in one dot line of a laser scanner is detected and fixing setting conditions are changed according to the overlapping state.

In the above patent documents, however, the toner amount of the recording material corresponding to the position where a thermistor as a temperature detection unit is provided to perform temperature control, is not considered. In such systems, when fixing setting conditions are determined, another problem arises. That is, different power is turned on depending on the toner amount at a position in a longitudinal direction (direction perpendicular to a conveyance direction of the recording material) (longitudinal position) where a thermistor is set up. More specifically, as an amount of toner increases in the thermistor position, more power is turned on, which leads to waste of power.

A fixing apparatus determines the power to be turned on depending on the temperature detected by the thermistor. If the detected temperature is lower than the setting temperature, the fixing apparatus maintains the setting temperature by correspondingly turning on more power. Therefore, more power is turned on while heat is drawn from the fixing sleeve or the like as a temperature detection target by the recording material and toner. Therefore, the fixing sleeve is deprived of more amount of heat as an amount of toner increases in an area where the thermistor is set up in the longitudinal direction, so that the fixing apparatus is operated to turn on more power.

If, for example, a wholly printed (solidly printed) toner image is present only on one side in FIG. 16, more power is turned on according to conventional technology when the position of a thermistor corresponds to an area P where the amount of toner is larger than when the position of a thermistor corresponds to an area Q. Thus, though the needed amount of heat is the same regardless of the position of the thermistor, power is wasted.

SUMMARY

According to one or more aspects of the present disclosure, an image forming apparatus that forms a toner image on a recording material includes an image forming unit that forms the toner image on the recording material, a fixing unit that fixes the toner image formed on the recording material in the image forming unit, wherein the fixing unit includes a heating member and an opposed member forming a nip portion together with the heating member and the recording material on which the toner image has been formed by the nip portion is heated and conveyed, a temperature detection member that detects a temperature of the heating member, a control unit that controls power to be supplied to a heater so that a detected temperature by the temperature detection member becomes a target temperature, and an acquisition unit that acquires toner density information of the toner image formed on the recording material, wherein the acquisition unit acquires first toner density information as the toner density information in a predetermined area as a portion of a maximum image formation area of the recording material and second toner density information as the toner density information in the maximum image formation area and the predetermined area is an area including an area of the recording material corresponding to a detected area of the heating member by the temperature detection member, wherein the control unit sets the target temperature based on the first toner density information and the second toner density information.

Further features of the present disclosure will become apparent from the following description of exemplary embodiments with reference to the attached drawings.

BRIEF DESCRIPTION OF THE DRAWINGS

FIG. 6 is a table illustrating an image failure temperature when the amount of toner in an area A is different and a setting temperature is changed.

FIG. 7 is a table illustrating a power reduction effect in the first exemplary embodiment.

FIG. 10 is a table illustrating the image failure temperature when the amount of toner in an area B is different and the setting temperature is changed.

FIG. 12 is a table illustrating the power reduction effect in the second exemplary embodiment.

FIG. 14 is a table illustrating an image pattern used in the third exemplary embodiment and an appropriate setting temperature.

FIG. 15 is a table illustrating comparison results of fixability in the third exemplary embodiment and Comparative Examples 1 and 2.

DESCRIPTION OF THE EMBODIMENTS

Hereinafter, exemplary embodiments of one or more aspects the present disclosure will be described in detail with reference to the attached drawings. However, dimensions, materials, and shapes of components described in the following embodiments and relative arrangements thereof should be appropriately changed depending on the configuration of an apparatus to which the present disclosure is applied and various conditions, and do not intend to limit the scope of the present disclosure to the following embodiments.

(Image Forming Apparatus)

Figure 1:
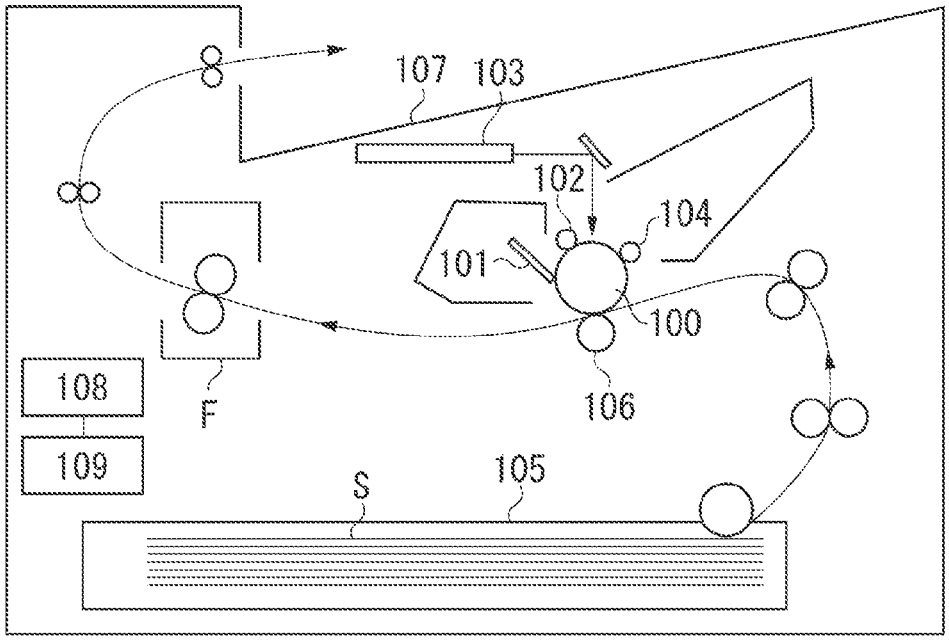
FIG. 1 is a schematic diagram of an image forming apparatus according to one or more aspects of the present disclosure.

Hereinafter, the first exemplary embodiment will be described. FIG. 1 is a sectional view illustrating an image forming apparatus including an image forming unit and a fixing unit (fixing apparatus) F. Here, the image forming unit in which an unfixed toner image is formed on the surface of a photosensitive drum 100 will be described using FIG. 1 together with the flow of image formation. An electrophotographic apparatus as an image forming apparatus according to the present exemplary embodiment includes the photosensitive drum 100 and the photosensitive drum 100 is rotated clockwise by a motor (not illustrated). Unnecessary toner is removed by bringing a cleaning unit 101 into contact with the surface of the photosensitive drum 100.

Then, the surface of the photosensitive drum 100 is charged to have a uniform potential by a charging unit 102. An electrostatic latent image is formed on the surface of the photosensitive drum 100 by a scanner apparatus 103. Then, an unfixed toner image (toner image) corresponding to the electrostatic latent image is formed on the surface of the photosensitive drum 100 by a developing apparatus 104.

A recording material S is conveyed by a conveyance unit from a paper feed tray 105 in an arrow direction. The toner image formed on the photosensitive drum 100 is transferred to the recording material S in a nip portion formed between the photosensitive drum 100 and a transfer apparatus 106 constituting a transfer unit. The toner image is conveyed to a fixing apparatus F as a fixing unit while being attached to the recording material S by electrostatic attraction power. Then, the toner image is pressed/fused by the fixing apparatus F to become a fixed image. Thereafter, the recording material S is discharged to a discharge tray 107.

The image forming apparatus also includes a control unit 108 as a temperature control unit (heating control unit) and exercises temperature control (heating control) of the fixing apparatus F. A video controller 109 functioning as a toner amount detection unit capable of detecting the amount of toner calculates the amount of toner from image information when an image signal is received from a host computer (not illustrated). After receiving a detection result, the control unit 108 switches the setting temperature to a temperature according to the detection result.

The units described throughout the present disclosure are exemplary and/or preferable modules for implementing processes described in the present disclosure. The modules can be hardware units (such as one or more processors, one or more memories, circuitry, a field programmable gate array, a digital signal processor, an application specific integrated circuit or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure.

(Fixing Apparatus)

Figure 2:
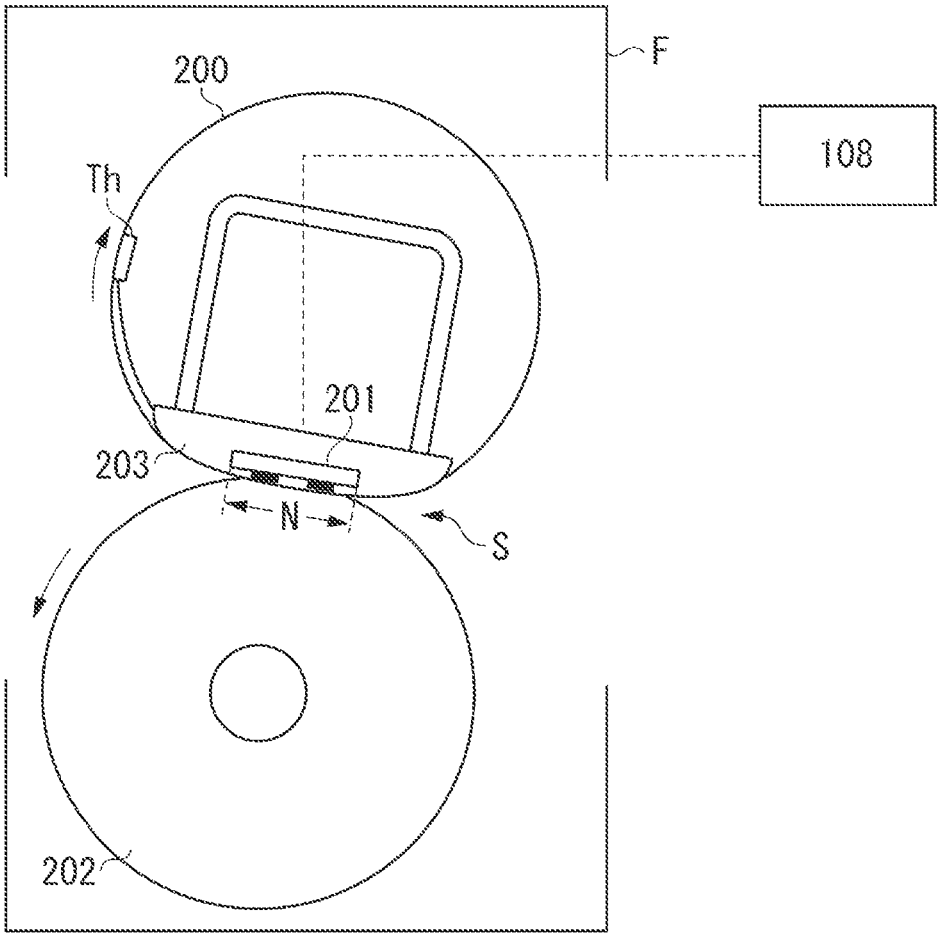
FIG. 2 is a schematic diagram of a fixing apparatus according to one or more aspects of the present disclosure.

Next, the fixing apparatus F will be described using FIG. 2. The fixing apparatus F includes a heating member having a fixing sleeve 200 and a heater 201 contacting the inner surface of the fixing sleeve 200. The fixing apparatus F also includes a pressure roller 202 as a pressure member (counter member) opposed to the heater 201 via the fixing sleeve 200 and forming a fixing nip portion (nip portion) N together with the heater 201.

The heater 201 is held by a holding member 203. The holding member 203 also has a function of guiding the rotation of the fixing sleeve 200. The pressure roller 202 rotates counterclockwise while receiving mechanical power from a motor (not illustrated). Then, driven by the rotation of the pressure roller 202, the fixing sleeve 200 is also rotated in an arrow direction (clockwise).

A thermistor Th as a temperature detection member is set up on the inner surface of the fixing sleeve 200. The fixing apparatus F is connected to the control unit 108. The fixing sleeve 200 is controlled to stand at the setting temperature by supplying the power calculated by the control unit 108 according to the temperature detected by the thermistor Th, to the heater 201 from an external power supply. Then, the recording material S carrying a toner image is fixed in the nip portion N while being sandwiched and conveyed from an arrow direction. Besides, the thermistor Th may be configured to detect the temperature of the heater 201.

In the present exemplary embodiment, the following configuration is used for the fixing apparatus F. That is, the fixing sleeve 200 is configured to have a stainless steel (SUS) base layer having the outside diameter 24 mm and the thickness 30 μm, an elastic layer made of a heat conductive rubber layer of 200 μm on the outer side thereof, and a release layer made of a perfluoroalkoxy alkane (PFA) tube of 20 μm as the outermost layer.

A method for reducing the influence of heat capacity by setting up a temperature control detection unit such as a thermistor on the outer surface of the fixing sleeve 200 can be considered. However, in the present exemplary embodiment, the thermistor Th is set up on the inner surface of the fixing sleeve 200. If the thermistor Th is set up on the inner surface of the fixing sleeve 200 as in the present exemplary embodiment, the fixing sleeve 200 is more subject to influence of the amount of toner when a heat capacity of the fixing sleeve 200 decreases.

The fixing sleeve 200 desirably has a smaller heat capacity and the heat capacity of the fixing sleeve 200 in the present exemplary embodiment is 0.05 J/K per 1 mm in the longitudinal direction (direction perpendicular to the conveyance direction of the recording material). If the heat capacity per 1 mm in the longitudinal direction at the position of the thermistor Th in the present exemplary embodiment is 0.15 J/K or less, an effect of power reduction described below can more easily be obtained due to the influence of the amount of toner.

The pressure roller 202 has the outside diameter 25 mm and is configured to include an iron cored bar whose outside diameter is 19 mm, an elastic layer made of silicone rubber whose thickness is 3 mm, and a release layer made of a PFA tube of 40 μm as the outermost layer.

The heater 201 is printed on an alumina substrate such that the total heating resistance value is 10Ω and is insulation-coated with glass. An external voltage 120 V is input and the conveyance speed of the recording material S in the nip portion N is set to 240 mm/sec. LTR-P size paper with grammage of 75 g/m$^2$ is used as the recording material and the throughput is set to 30 ppm.

Figure 3:
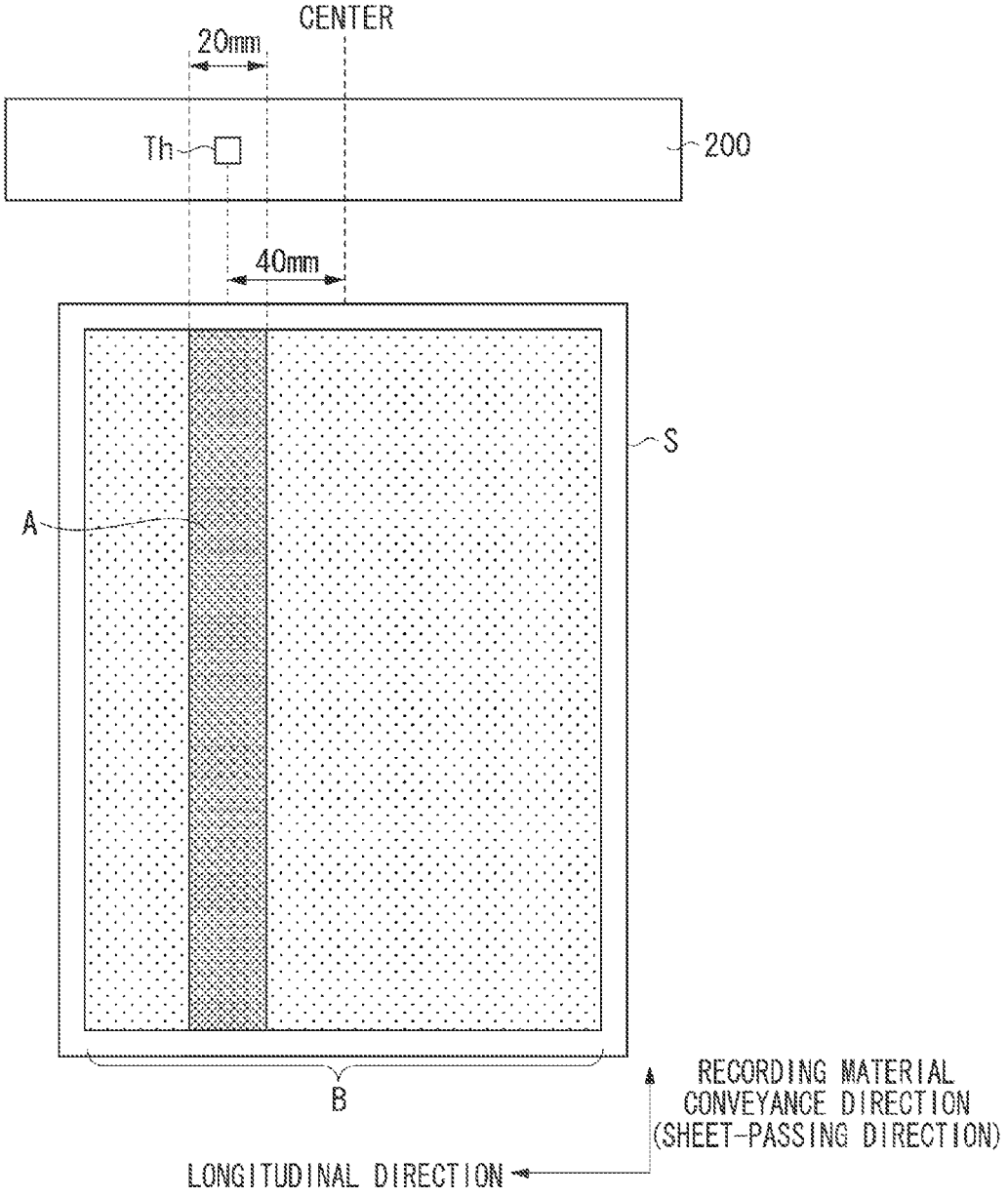
FIG. 3 is a diagram illustrating a longitudinal position of a thermistor according to one or more aspects of the present disclosure.

FIG. 3 is a diagram illustrating a relationship between the longitudinal position (position in the longitudinal direction) of the thermistor Th in the present exemplary embodiment and an area A where the amount of toner of the recording material is measured (the relevant area of the recording material corresponding to a first area where the thermistor is provided in the longitudinal direction). The thermistor Th is arranged in a position in the longitudinal direction shifted by 40 mm to the outer side from the center position in sheet passing of the recording material S. The area A is set as an area of the width 20 mm centered on the thermistor Th excluding a margin of 5 mm. That is, the area A is a predetermined area of the recording material including an area of the recoding material corresponding to a detection area of the fixing sleeve 200 by the thermistor Th. The area A is a portion of the whole image area (maximum image formation area) of the recording material. Here, as illustrated in FIG. 3, the whole image area including the area A is defined as an area B.

(Setting Temperature)

The present exemplary embodiment has such a feature that the control unit 108 determines the setting temperature (target temperature) at which the control unit 108 heats the heater 201 by considering the amount of toner (toner density) in the relevant area (area A) of the recording material. The relevant area corresponds to the position (area) where the thermistor Th is provided in the longitudinal direction illustrated in FIG. 3. That is, in the present exemplary embodiment, the control unit 108 acquires at least information about the output of the thermistor Th and the amount of toner (toner density) in the relevant area (area A) of the recording material and, based on the toner density, performs control to heat the heater 201.

More specifically, power input into the heater 201 is controlled such that the temperature detected by the thermistor Th is maintained at the setting temperature (target temperature) that decreases as an amount of toner detected by a second detection unit increases (as a toner density increases).

(Flowchart)

Figure 4:
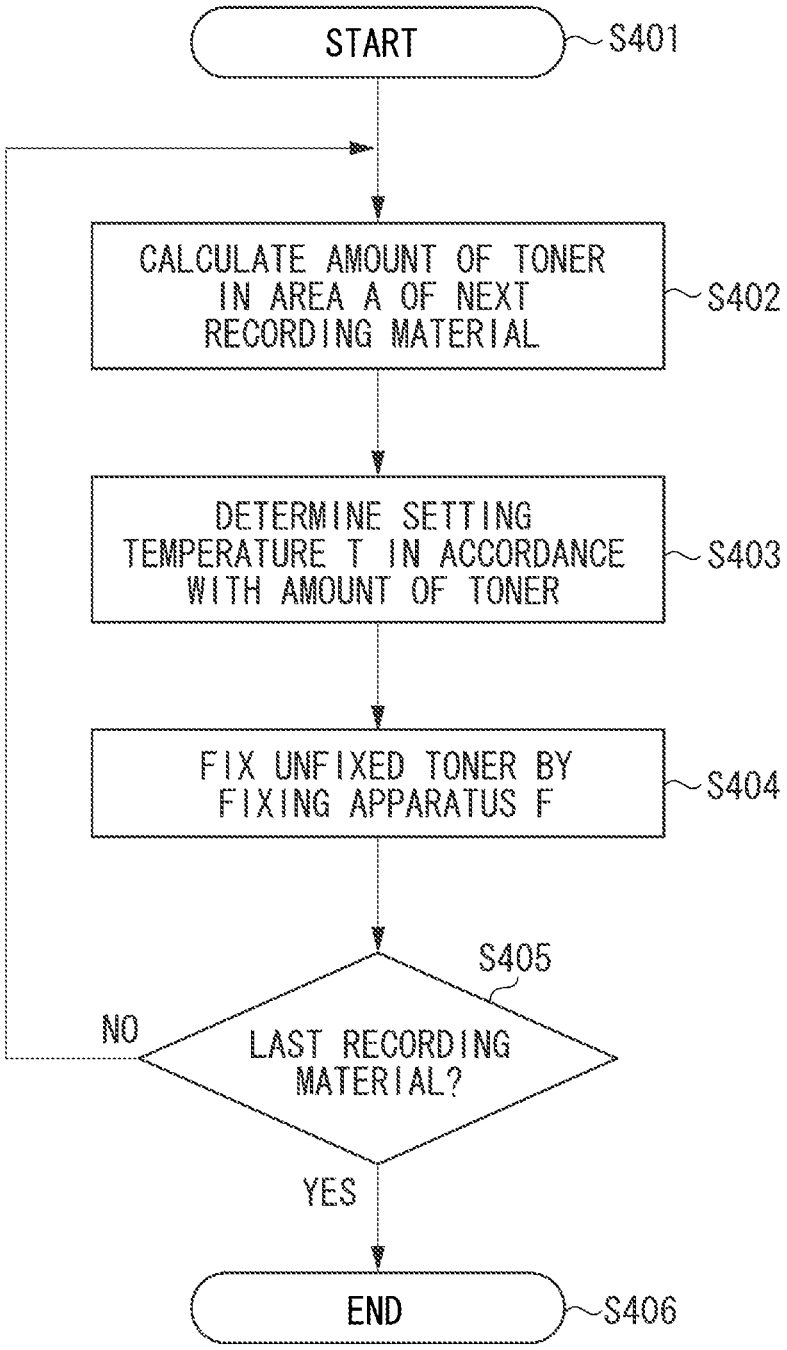
FIG. 4 is a control flowchart in a first exemplary embodiment.

A control flowchart in the present exemplary embodiment is illustrated in FIG. 4. When printing is started, in step S401, after a print job (job) is received, the image forming apparatus calculates (acquires) from image information received by the video controller 109 in step S402, the amount of toner (toner density information) in the area A of the recording material that will next pass through the fixing apparatus F. Next, in step S403, the control unit 108 determines the setting temperature T from a control formula (1) described below based on the calculated amount of toner.

Then, in step S404, the image forming apparatus fixes unfixed toner (toner image) by passing the recording material through the fixing apparatus F controlled to have the determined setting temperature T. Then, in step S405, the image forming apparatus determines whether the recording material is the last recording material in the print job. If the recording material is the last one (YES in step S405), the image forming apparatus terminates the printing operation in step S406. On the other hand, if the job continues (NO in step S405), the processing returns to the calculation of the amount of toner in step S402 to repeat the process until the last recording material. In the present exemplary embodiment, the control is exercised in the above flow.

The relation between the calculated amount of toner and the setting temperature T [° C.] is determined by the following control formula (1) in which the average amount of toner in the area A is X [mg/cm$^2$].

$$T=180-10X \quad (1)$$

Figure 5:
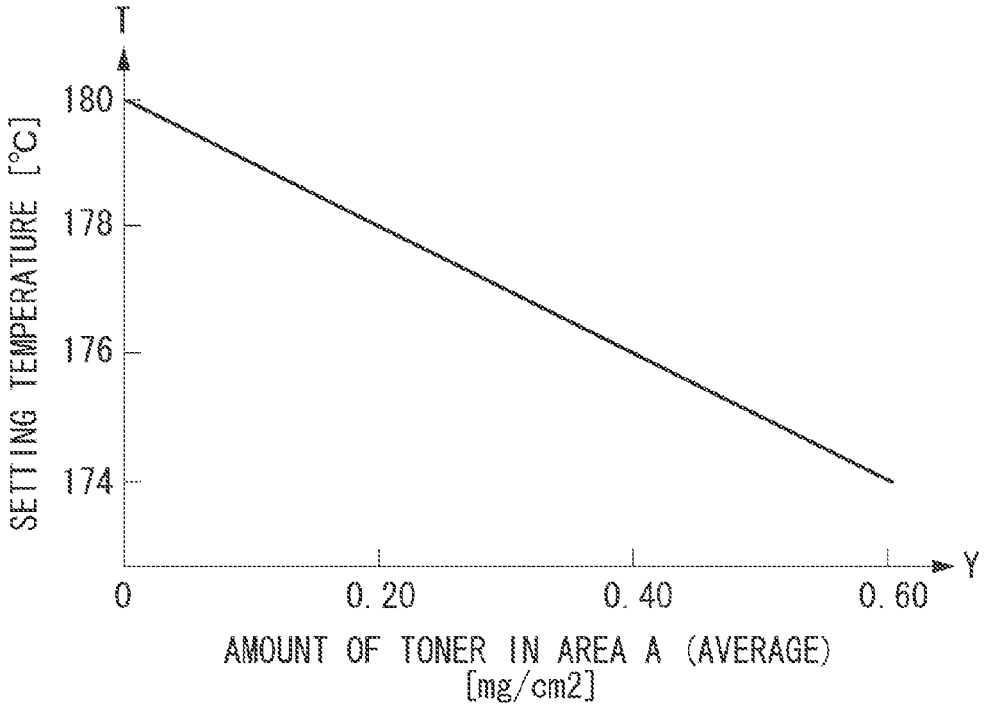
FIG. 5 is a graph of a control formula (1) in the first exemplary embodiment.

This control formula (1) is determined by "the minimum temperature at which no image failure occurs even if the amount of toner in the area A increases/decreases when the amount of toner outside the area A is the largest" and graphically illustrated in FIG. 5. The largest amount of toner in the present exemplary embodiment is 0.60 [mg/cm$^2$] when the image density is the highest and the amount of toner is 0.00 [mg/cm$^2$] when there is no image at all.

The average amount of toner X in the present exemplary embodiment is calculated from an area ratio forming a toner image based on an image received by the video controller 109. For example, the area ratio of a solid image in which the whole surface is printed in the highest density is 100% and thus, the average amount of toner X is 0.60 [mg/cm$^2$]. When characters whose area ratio is 8% are printed on the whole surface, the average amount of toner X is about 0.05 [mg/cm$^2$].

Regarding the control formula (1), the reason for considering that the amount of toner is the largest outside the area A is that if fixability can be satisfied under the condition of the largest amount of toner outside the area A, fixability can be secured even if the amount of toner outside the area A is smaller.

The table in FIG. 6 illustrates the relation between the setting temperature and an image failure when the amount of toner in the area A and the amount of toner outside the area A are specified as illustrated in the table. The setting temperature is shown from 168° C. to 188° C. in increments of 2° C. In the table, "Fixing" shows the evaluation of a fixing failure and "Off" shows the evaluation of an offset. "○" indicates that there is no failure at all, "Δ" indicates a permissible failure level, though a minor failure is detected, and "x" indicates a level at which an apparent failure can be verified. For example, the pattern 1-1 at 174° C. indicates a setting in which there is no offset problem, but fixability is unacceptable.

In the present exemplary embodiment, the control formula (1) is determined based on the above experimental results so that the minimum setting temperature is obtained. Respective minimum temperatures are: 180° C. for the pattern 1-1, 178° C. for the pattern 1-2, 176° C. for the pattern 1-3, and 174° C. for the pattern 1-4. The above relations are formed as the control formula (1).

Effect of Present Exemplary Embodiment

The effect of the present exemplary embodiment was compared with conventional technology (i.e., in a case where the present exemplary embodiment is not applied). FIG. 7 illustrates measured average power for each pattern when 200 sheets are continuously passed. The setting temperature is not changed depending on the amount of toner in the area A in the conventional technology and the temperature stands at 180° C. for all patterns 1-1 to 1-4. In the conventional technology, the setting temperature is constant regardless of the amount of toner in the area A and thus, power input increases as the amount of toner increases in the area A.

In the present exemplary embodiment, by contrast, almost constant power is input independently of the amount of toner in the area A. Thus, as illustrated in FIG. 7, the power could be reduced in the pattern 1-4 by 29 [W] in which the amount of toner in the area A is the largest.

In the present exemplary embodiment, as described above, the power can be reduced without a fixing failure and an adverse effect of offset by adopting the setting temperature considering the amount of toner of the recording material corresponding to the longitudinal position of the thermistor Th.

In the present exemplary embodiment, the amount of toner is calculated from image information sent to the video controller 109 (FIG. 1). However, the present exemplary embodiment is not limited to such an example and any means that determines (detects) the amount of toner may be similarly used. This also applies to other exemplary embodiments. For example, a method for directly measuring the amount of toner of the recording material with an optical sensor may be used.

Hereinafter, the second exemplary embodiment will be described. The configuration of the image forming apparatus and the fixing apparatus in the present exemplary embodiment are the same as those in the first exemplary embodiment, and therefore, the description thereof is omitted. The present exemplary embodiment has a feature that a reference setting temperature To is calculated from the amount of toner in the area B in FIG. 3 and the setting temperature T is determined according to the amount of toner in the position of the thermistor Th (area A).

In the first exemplary embodiment, control is exercised such that no fixing failure occurs even when the amount of toner in the area B is the largest (solid image). In the present exemplary embodiment, the reduction of power is achieved by considering the amount of toner in the area B. In the present exemplary embodiment, the setting temperature T increases as an amount of toner increases in the area B and the setting temperature T decreases as an amount of toner increases in the area A.

(Flowchart)

Figure 8:
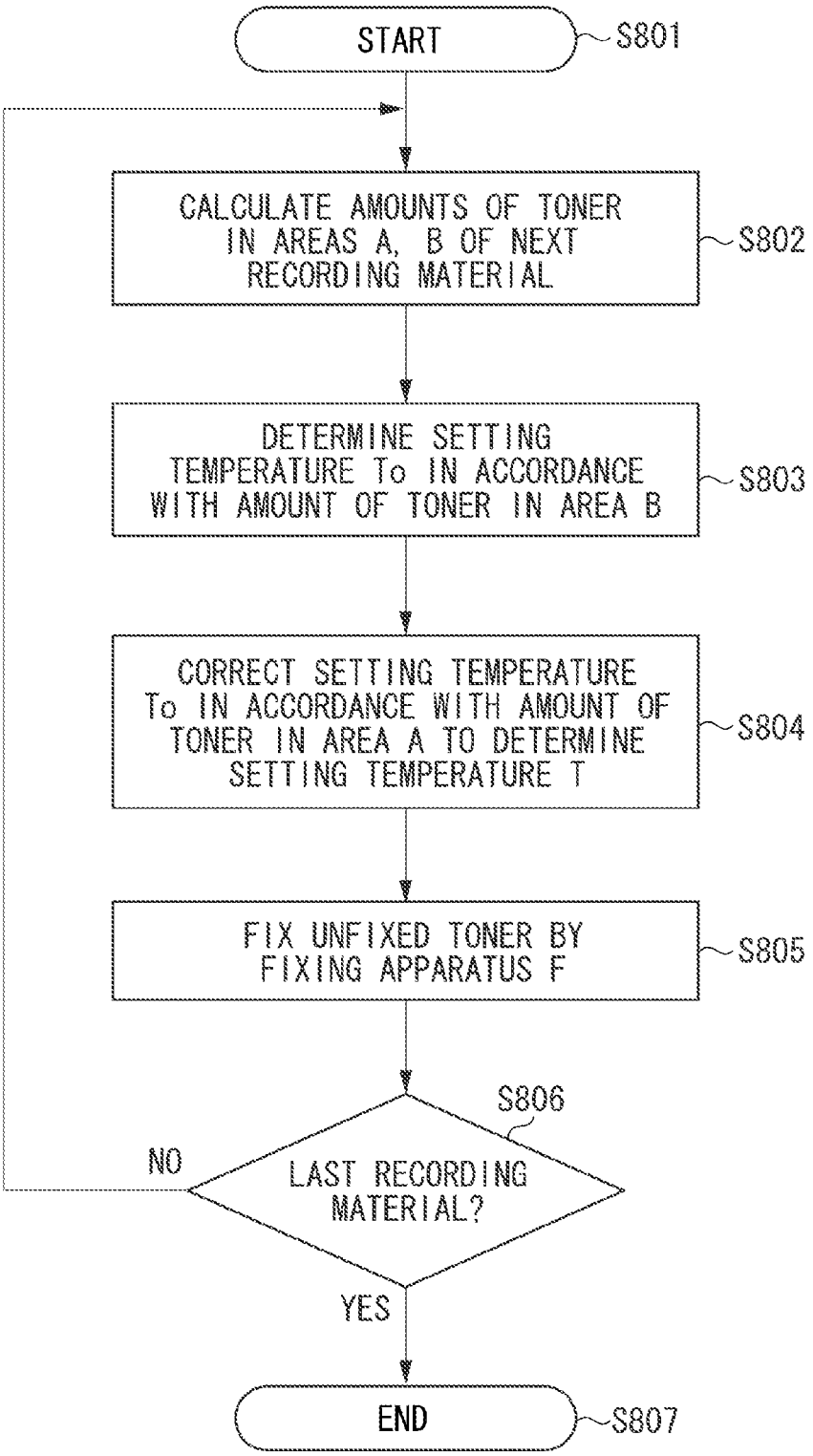
FIG. 8 is a control flowchart in a second exemplary embodiment.

A control flowchart in the present exemplary embodiment is illustrated in FIG. 8. When printing is started, in step S801, after a print job is received, the image forming apparatus calculates from image information received from the video controller 109 in step S802, the amount of toner in the area B (FIG. 3) of the recording material that will next pass through the fixing apparatus F. Next, in step S803, the image forming apparatus calculates the reference setting temperature To from a control formula (2) described below based on the calculated amount of toner.

In step S804, the image forming apparatus corrects the determined reference setting temperature (reference target temperature) To according to the amount of toner in the area A based on a control formula (3) described below to calculate the setting temperature T as a control temperature. Then, in step S805, the image forming apparatus fixes unfixed toner by passing the recording material through the fixing apparatus F which is controlled to stand at the determined setting temperature T. In step S806, the image forming apparatus determines whether the recording material is the last recording material in the print job. If the recording material is the last one (YES in step S806), the image forming apparatus terminates the printing operation in step S807. If the job continues (NO in step S806), the processing returns to the calculation of the amount of toner in step S802 to repeat the process until the last recording material. In the present exemplary embodiment, the control is exercised in the above flow.

The relation between the amount of toner in the area B and the reference setting temperature To [° C.] is determined by a following control formula (2) in which the maximum value of the amount of toner in the area B is Y [mg/cm$^2$].

$$To=174+10Y \tag{2}$$

Figure 9:
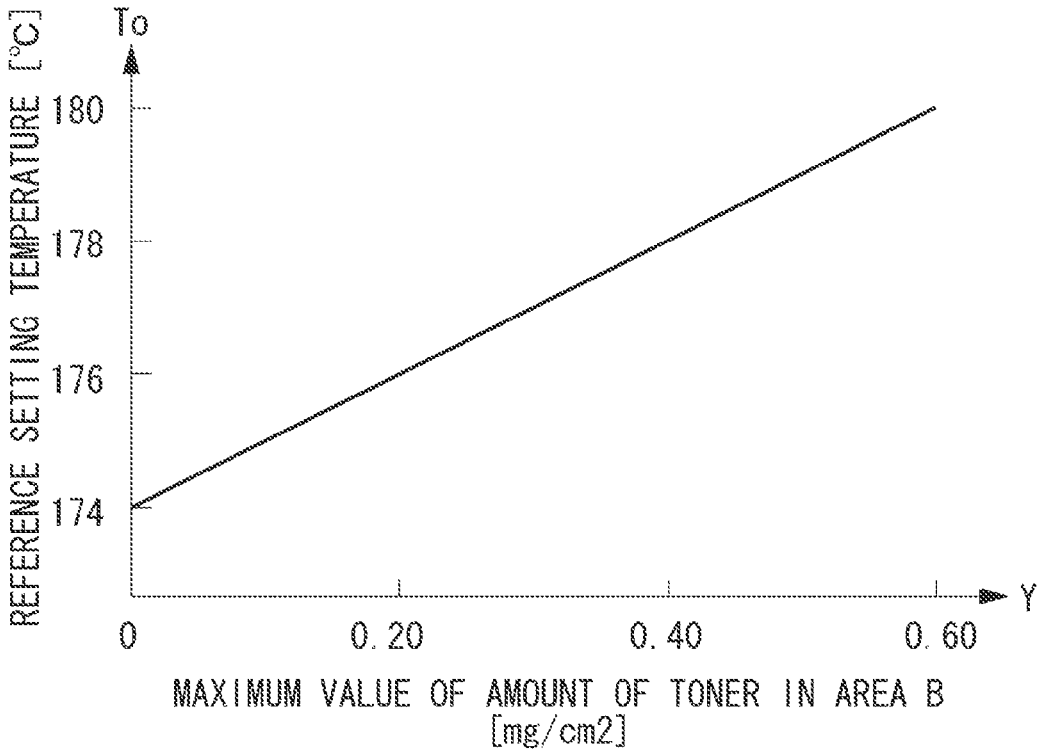
FIG. 9 is a graph of a control formula (2) in the second exemplary embodiment.

This control formula (2) is determined by "the setting temperature at which fixability can be satisfied even if the amount of toner in the area B changes when there is no toner in the area A" and is graphically illustrated in FIG. 9. The reason for defining the amount of toner in the area B by the maximum value in FIG. 9 is that if a determination is made on the basis of the average value, a halftone image in a wider area and a solid image in a narrower area cannot be distinguished.

A solid image has a larger amount of toner per unit area and so the fixing temperature needs to be set higher. In the present exemplary embodiment, halftone images and solid images are distinguished by setting, among average values of the amount of toner in areas obtained by dividing an image into squares of 1.5 mm, the largest amount of toner as the maximum value of the area B to calculate an appropriate reference setting temperature To.

FIG. 10 is a table illustrating the relation between the setting temperature and an adverse effect on an image when various amounts of toner are specified for the areas A and B. A way of viewing the table is similar to FIG. 6 (first exemplary embodiment). In FIG. 10, the amount of toner in the area A is fixed and thus, the needed amount of heat increases as an amount of toner increases in the area B and the setting temperature needs to be set higher. The control formula (2) is determined based on FIG. 10 so that the minimum setting temperature satisfying the fixability is obtained.

In the present exemplary embodiment, as described below, the final setting temperature T [° C.] is determined by correcting the reference setting temperature To according to the amount of toner in the area A. The relation between the amount of toner in the area A and the setting temperature T [° C.] is determined by a following control formula (3) in which the average value of the amount of toner in the area A is X [mg/cm$^2$].

$$T=To-10X \quad (3)$$

Figure 11:
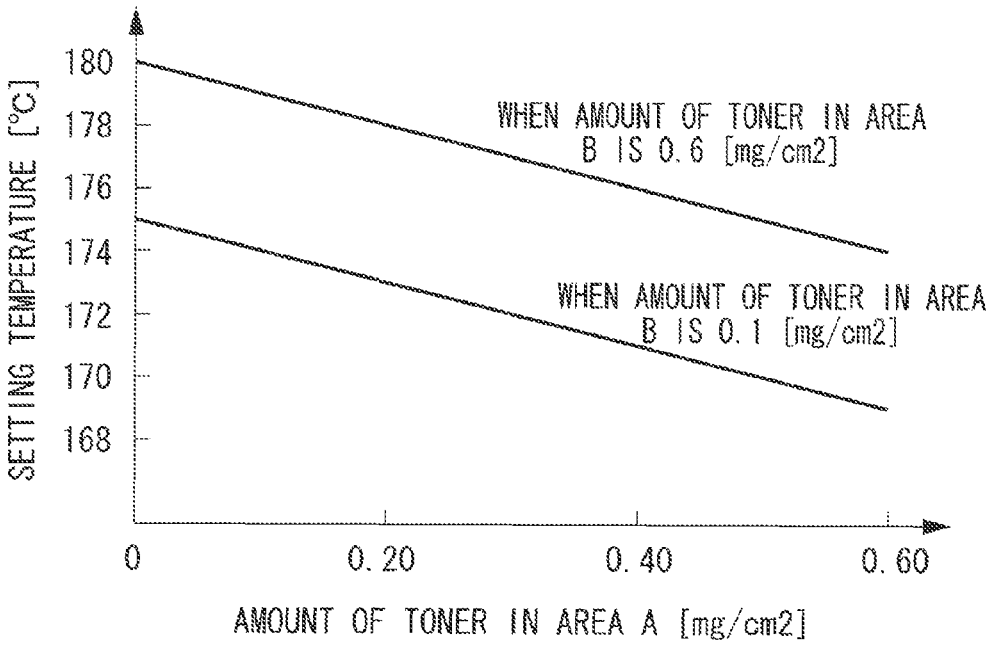
FIG. 11 is a graph of a control formula (3) in the second exemplary embodiment.

Results obtained when the amount of toner in the area B is 0.60 [mg/cm$^2$] and 0.1 [mg/cm$^2$] in the above control formula (3) are graphically illustrated in FIG. 11. The setting temperature falls as an amount of toner increases in the area A even if the amount of toner in the area B is the same. The setting temperature rises as an amount of toner increases in the area B even if the amount of toner in the area A is the same.

Effect of Present Exemplary Embodiment

The effect of the present exemplary embodiment is compared with the first exemplary embodiment. FIG. 12 illustrates results of measuring average power for each pattern when 200 sheets are continuously passed. By considering also the amount of toner in the area B, the power could be reduced by 19 [W] in the pattern 1-4 in which the effect is the largest compared with the first exemplary embodiment.

In the present exemplary embodiment, as described above, the setting temperature is set by considering, in addition to the amount of toner in the relevant area of the recording material corresponding to the longitudinal position of the thermistor Th, the amount of toner outside the area of the thermistor. Accordingly, more power can be reduced than in the first exemplary embodiment without a fixing failure and an adverse effect of offset.

In the present exemplary embodiment, feedback is given to the setting temperature by calculating the amount of toner for each sheet of the recording material. However, the present exemplary embodiment is not limited to such an example and, for example, the setting temperature may be switched by calculating the amount of toner collectively for each print job. Such switching of the setting temperature acts effectively when processing of the video controller is not in time due to speedup or the same image is printed repeatedly.

Further, the area of the recording material may be divided in a sheet-passing direction to switch the setting temperature for each area. That is, the area may be divided into a plurality of areas (for example, B1, B2, B3, and B4) in the recording material conveyance direction (sheet-passing direction) in FIG. 17, so that the setting temperature can be switched for each area. Such switching of the setting temperature acts effectively when many image patterns in which the amount of toner switches significantly in the sheet-passing direction are printed.

Hereinafter, the third exemplary embodiment will be described. The configuration of the image forming apparatus and the fixing apparatus in the present exemplary embodiment are the same as those in the first and second exemplary embodiments, so that the description thereof is omitted. The present exemplary embodiment has a feature that the setting temperature T (n) in the fixing apparatus F (FIG. 1) for the n-th recording material passing through the transfer apparatus 106 (FIG. 1) constituting a transfer unit is not determined based on only toner amount information. More specifically, the present exemplary embodiment has a feature that the temperature set to the n-th recording material is offset based on the magnitude relation to the setting temperature set to the previous (n−1)-th recording material or the setting temperature set to the subsequent (n+1)-th recording material.

In the first and second exemplary embodiments, the setting temperature is determined and controlled for each recording material, but when further speed up of the image forming apparatus is desired, if the setting temperature is different between respective recording materials, there is a concern that a fixing failure may be caused when the temperature of the fixing sleeve 200 cannot follow change in temperature control. Thus, the degree of freedom of the setting temperature that can be selected is narrowed and the effect of power reduction is lowered. However, in the present exemplary embodiment, the power can be effectively reduced even in a case of speed-up of the apparatus in the determination of a certain setting temperature T (n) by offsetting such that the temperature of the fixing sleeve 200 can follow the change in temperature control.

(Flowchart)

Figure 13:
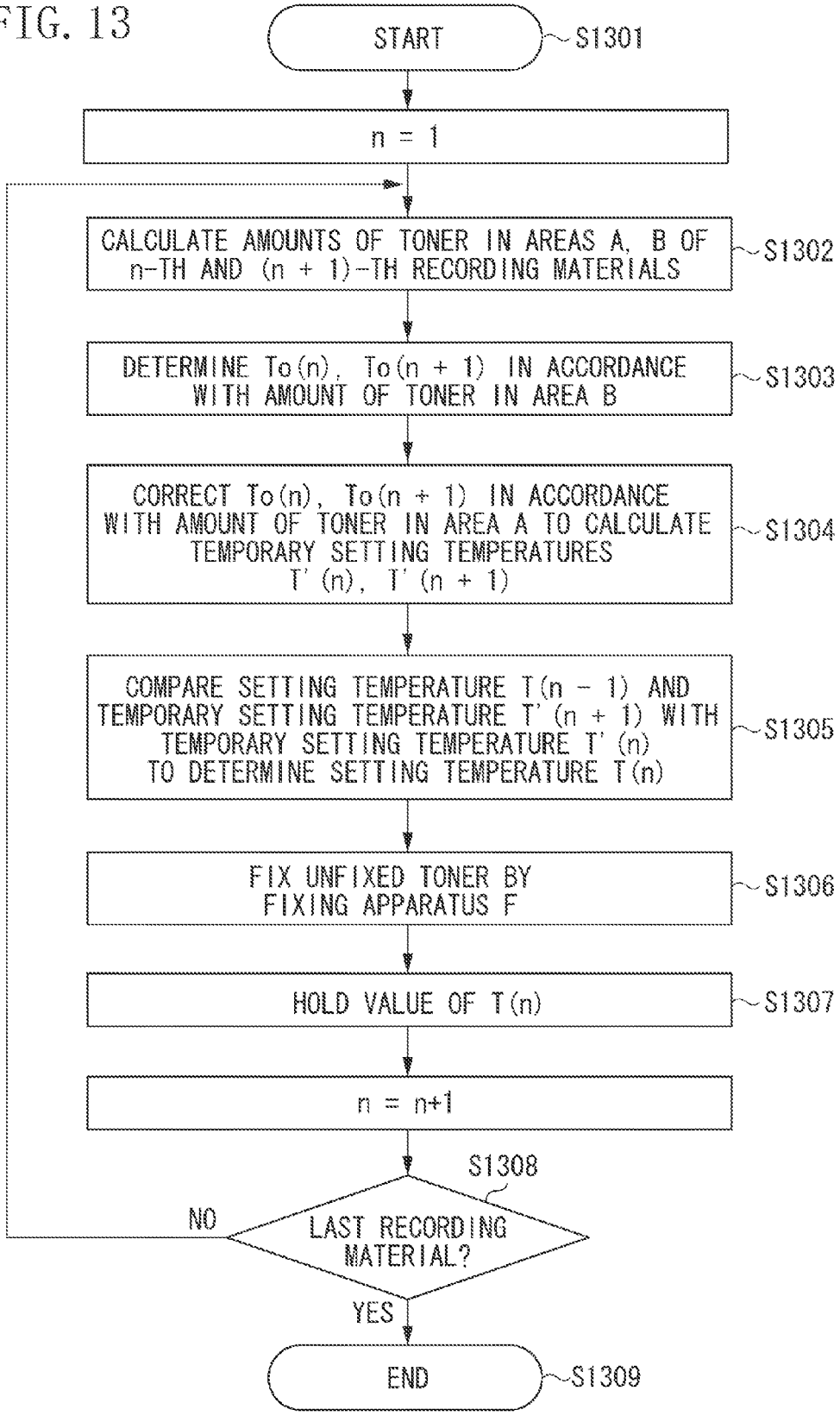
FIG. 13 is a control flowchart in a third exemplary embodiment.
Figure 16:
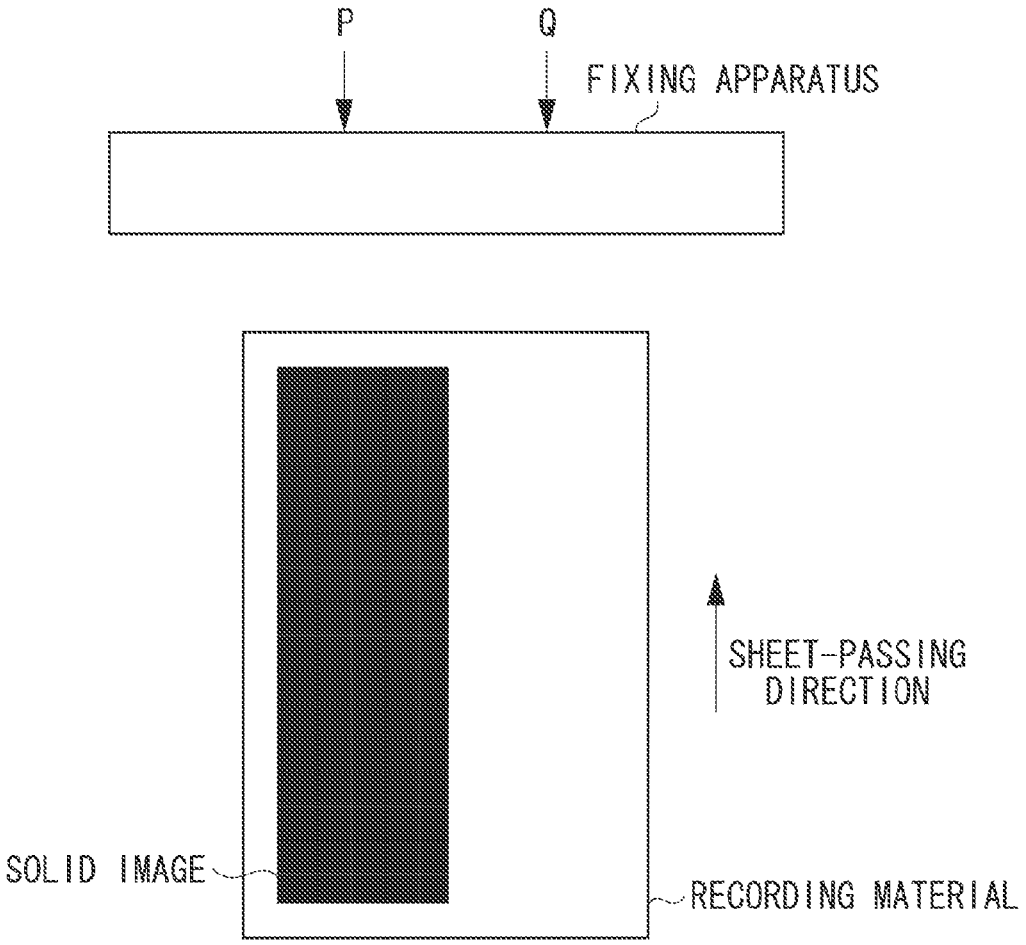
FIG. 16 is a diagram illustrating a problem of the present disclosure.

A control flowchart in the present exemplary embodiment is illustrated in FIG. 13. In step S1301, the image forming apparatus receives a print job and starts printing. Then, in step S1302, the image forming apparatus calculates from image information received by the video controller 109 the amount of toner in the area B of the n-th recording material that will next pass through the fixing apparatus and the amount of toner in the area B of the (n+1)-th recording material that will pass through the fixing apparatus thereafter. Then, in step S1303, the image forming apparatus determines reference setting temperatures To (n), To (n+1) based on the calculated amounts of toner.

In step S1304, the image forming apparatus corrects the determined reference setting temperatures To (n), To (n+1) according to the amount of toner in the area A to calculate temporary setting temperatures T' (n), T' (n+1). In step S1305, an offset is added to the determined reference setting temperatures T' (n), T' (n+1) based on a control formula (4) described below to calculate a setting temperature T (n). In step S1306, the image forming apparatus fixes unfixed toner by passing the recording material through the fixing apparatus F which is controlled to stand at the setting temperature T (n).

Then, in step S1307, the image forming apparatus holds T (n) to determine the next control temperature. Then, in step S1308, the image forming apparatus determines whether the recording material is the last recording material in the print job. If the recording material is the last one (YES in step S1308), the image forming apparatus terminates the printing operation in step S1309. If the job still continues (NO in step S1308), the processing returns to the calculation of the amount of toner in step S1302 to repeat the process until the last recording material. In the present exemplary embodiment, the control is exercised in the above flow.

The amount of offset added in step S1305 of the flowchart is determined by comparing the setting temperature T (n−1) of the recording material ((n−1-th) which has just preceded, the temporary setting temperature T' (n) of the n-th recording material, and the temporary setting temperature T' (n+1) of the (n+1)-th recording material. More specifically, as shown in a control formula (4) below, if T (n−1) or T' (n+1) is higher than T' (n), half of the difference from T' (n) is added to T' (n) as an offset. For the first or last recording material, there is no information about T (n−1) or T' (n+1) and a calculation is done without considering such information.

$$T(n) = T'(n) + \frac{\mathrm{Max}\{T(n-1)\cdot T'(n)\cdot T'(n+1)\} - T'(n)}{2} \quad (4)$$

If T (n−1) or T' (n+1) is lower than T' (n), no offset is added. This is because the temporary setting temperature T' (n) of the n-th recording material is a temperature needed to fix an image of the calculated amount of toner and a fixing failure may occur if the temperature is set lower.

Effect of Present Exemplary Embodiment

FIG. 14 is a table illustrating the amount of toner in each area used to verify the effect of the present exemplary embodiment and the optimum setting temperature for each amount of toner. For the fourth recording material, for example, the amount of toner in the area A is 0.00 [mg/cm$^2$] and the amount of toner in the area B is 0.30 [mg/cm$^2$]. The optimum temperature when the image is continuously passed under conditions described below is 200° C.

Comparison with Comparative Examples

Here, the present exemplary embodiment is compared with Comparative Examples 1, 2 (a sheet is passed under control according to the second exemplary embodiment) as described below. FIG. 15 is a table illustrating results of fixability obtained in Comparative Examples 1, 2 and results of fixability obtained in the present exemplary embodiment. The comparison was made in the sheet-passing pattern in FIG. 14 in which two images were switched every three sheets and the conveyance speed in the fixing apparatus was set to 300 mm/sec and the throughput thereof was set to 50 ppm.

1) Comparative Example 1

Comparative Example 1 shows a result when control is performed at the optimum setting temperature for each amount of toner without offset based on the previous and subsequent setting temperatures. The present comparative example is set faster compared with the second exemplary embodiment and thus, a fixing failure occurred immediately after switching from a lower temperature to a higher temperature (the fourth and the tenth). This is because the temperature of the fixing sleeve 200 does not follow the setting temperature. Also immediately after switching conversely from a higher temperature to a lower temperature (the seventh), undershooting of temperature occurred due to a large temperature control change and a fixing failure, though permissible, was observed.

2) Comparative Example 2

Comparative Example 2 shows a result when sheets are passed in the range in which the fixing sleeve 200 can follow the setting temperature without offset based on the previous and subsequent setting temperatures. While the temperature is set to 190° C. before shifting to 200° C. in Comparative Example 1, the temperature is set to 195° C. before shifting to 200° C. in the present comparative example, which makes smaller the difference between temperatures to be switched, so that a fixing failure can be suppressed. However, a higher setting temperature needs to be set to suppress the fixing failure, which lowers the effect of power reduction.

3) Present Exemplary Embodiment

Sheets are passed while rapid changes of the setting temperature are suppressed by offset based on the previous and subsequent setting temperatures. A fixing failure like Comparative Example 1 does not occur and recording materials (the first, second, and eighth) that caused no fixability problem in Comparative Example 2 could be passed at the setting temperature of 190° C., instead of 195° C. so that when compared with Comparative Example 2, the power could be reduced by 20 [W].

In the present exemplary embodiment, when determining the setting temperature T (n), the amount of offset is determined by comparing setting temperatures of the previous recording material and the subsequent one. This effect enables the calculation of a more effective setting temperature when the number of recording materials to be considered is increased. Accordingly, the present exemplary embodiment is not limited to the number of recording materials in the present exemplary embodiment.

In a case where the image forming apparatus is not affected by preceding recording materials, the control may be performed to calculate the setting temperature based on only preceding or subsequent setting temperatures, for example, calculating the offset based on the setting temperature of the subsequent recording material may be adopted.

Further, regarding the present exemplary embodiment, a greater effect can be achieved by adopting the control in which the area is divided in the sheet-passing direction of the recording material and the setting temperature is switched for each area, instead of each recording material. For example, as illustrated in FIG. 17, when the area is divided into four areas, which are first to fourth areas B1 to B4 in the sheet-passing direction of the recording material, the above offset can similarly be added.

Figure 17:
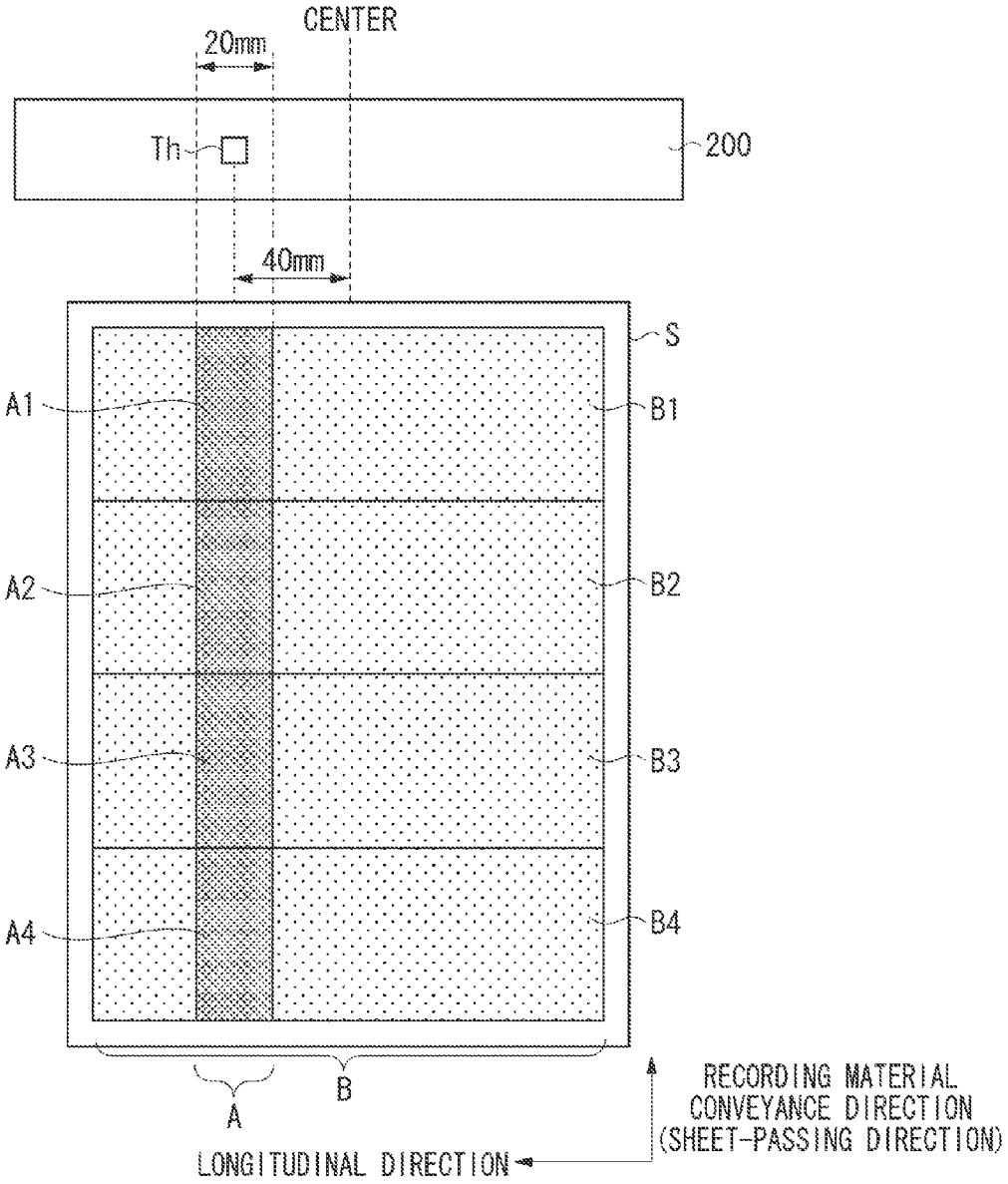
FIG. 17 is a diagram illustrating a modification.

For example, the setting temperature T (B2) of the second area B2 in FIG. 17 is determined as described below, instead of determining based on only toner amount information (the amount of toner in a portion of the area A2 and further, the amount of toner of the whole area B2). That is, the amount of toner of the second area B2 and the amount of toner of the third area B3 as a subsequent area are calculated. Then, based on the calculated amounts of toner, reference setting temperatures To (B2) and To (B3) are determined.

The determined reference setting temperatures To (B2) and To (B3) are corrected according to the amount of toner of the areas A2 and A3 to calculate temporary setting temperatures T' (B2) and T' (B3). The offset is added to the determined temporary setting temperatures T' (B2) and T' (B3) based on a control formula (4) described above to calculate the setting temperature T (B2).

More specifically, if the setting temperature T (B1) of the area B1 as the previous area or the temporary setting temperature T' (B3) is higher than the temporary setting temperature T' (B2), half of the difference from the temporary setting temperature T' (B2) is added to the temporary setting temperature T' (B2) as the offset. Besides, for the first area B1 and the fourth area B4, the setting temperature is calculated without adding such an offset.

Modification

The exemplary embodiments of the present disclosure have been described above, but the present disclosure is not limited to such exemplary embodiments and various modifications and alterations can be made without deviating from the spirit thereof.

First Modification

In the embodiments described above, the image forming apparatus is provided with the second detection unit (first toner amount detection unit) to detect the amount of toner of the recording material corresponding to the first area where a thermistor as the first detection unit is provided in the longitudinal direction. Further, the third detection unit (second toner amount detection unit) to detect the amount of toner of the recording material corresponding to the whole area including the first area in the longitudinal direction is provided.

However, the present disclosure is not limited to the above examples and the fixing apparatus may receive the amount of toner detected by the first toner amount detection unit and further, the amount of toner detected by the second toner amount detection unit by communication. That is, as a fixing apparatus provided with a first toner amount acquisition unit and further, a second toner amount acquisition unit, power can be similarly input to fix a toner image without wasting the turned-on power. Besides, the fixing apparatus includes an apparatus that heats and presses the toner image temporarily fixed on the recording material to improve gloss of the image.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2016-143009, filed Jul. 21, 2016, which is hereby incorporated by reference herein in its entirety.

What is claimed is:

1. An image forming apparatus that forms a toner image on a recording material comprising:

an image forming unit that forms the toner image on the recording material;

a fixing unit that fixes the toner image, formed on the recording material by the image forming unit, on the recording material, wherein the fixing unit includes a heating unit and an opposed member forming a nip portion together with the heating unit, and the recording material on which the toner image has been formed by the nip portion is heated and conveyed;

a temperature detection member that detects a temperature of the heating unit;

a control unit that controls power to be supplied to the heating unit so that a detected temperature by the temperature detection member becomes a target temperature; and an acquisition unit that acquires toner density information of the toner image to be formed on the recording material, wherein the acquisition unit acquires first toner density information and second toner density information, the first toner density information being the toner density information of the toner image to be formed on a predetermined area of the recording material which is a portion of a maximum image formation area of the recording material and which includes an area of the recording material corresponding to a detected area of the heating unit detected by the temperature detection member, the second toner density information being the toner density information of the toner image to be formed on the maximum image formation area of the recording material, wherein the control unit sets the target temperature based on the first toner density information and the second toner density information.

2. The image forming apparatus according to claim 1, wherein the target temperature is a temperature obtained by correcting a reference temperature to become higher as toner density according to the second toner density information is higher, so as to become lower when toner density according to the first toner density information is higher than a predetermined density, than when the toner density according to the first toner density information is lower than the predetermined density.

3. The image forming apparatus according to claim 1, wherein the heating unit includes a sleeve, and a heater in contact with an inner surface of the sleeve.

4. The image forming apparatus according to claim 3, wherein the heater forms the nip portion together with the opposed member across the sleeve.

5. The image forming apparatus according to claim 3, wherein the temperature detection member detects a temperature of the heater.

6. The image forming apparatus according to claim 1, wherein the first toner density information is an average amount of toner of the toner image to be formed on the predetermined area of the recording material, and the second toner density information is an average amount of toner of the toner image to be formed on the maximum image formation area of the recording material.

7. The image forming apparatus according to claim 1, wherein the predetermined area of the recording material does not include a center of the recording material in a direction orthogonal to a conveying direction of the recording material.

8. An image forming apparatus that forms a toner image on a recording material comprising:

an image forming unit that forms the toner image on the recording material;

a fixing unit that fixes the toner image, formed on the recording material by the image forming unit, on the recording material, wherein the fixing unit includes a heating unit and an opposed member forming a nip portion together with the heating unit, and the recording material on which the toner image has been formed by the nip portion is heated and conveyed;

a temperature detection member that detects a temperature of the heating unit;

a control unit that controls power to be supplied to the heating unit so that a detected temperature by the temperature detection member becomes a target temperature; and an acquisition unit that acquires toner density information of the toner image to be formed on the recording material, wherein the acquisition unit acquires the toner density information of the toner image to be formed on a predetermined area of the recording material which is a portion of a maximum image formation area of the recording material and which includes an area of the recording material corresponding to a detected area of the heating unit detected by the temperature detection member, wherein the control unit controls the target temperature to become lower as toner density according to the toner density information is higher.

9. The image forming apparatus according to claim 8, wherein the heating unit includes a sleeve, and a heater in contact with an inner surface of the sleeve.

10. The image forming apparatus according to claim 9, wherein the heater forms the nip portion together with the opposed member across the sleeve.

11. The image forming apparatus according to claim 9, wherein the temperature detection member detects a temperature of the heater.

12. The image forming apparatus according to claim 8, wherein the toner density information is an average amount of toner of the toner image to be formed on the predetermined area of the recording material.

13. The image forming apparatus according to claim 8, wherein the predetermined area of the recording material does not include a center of the recording material in a direction orthogonal to a conveying direction of the recording material.

* * * * *